US005980021A

United States Patent [19]

Nagoshi et al.

[11] Patent Number: 5,980,021

[45] **Date of Patent: *Nov. 9, 1999**

[54] INK JET RECORDING MEANS AND PACKAGING THEREFOR

[75] Inventors: Shigeyasu Nagoshi; Naoji Otsuka, both of Kawasaki; Hiromitsu Hirabayashi, Yokohama; Atsushi Arai, Kawasaki; Kentaro Yano, Yokohama; Hitoshi Sugimoto, Kawasaki; Miyuki Matsubara, Tokyo; Kiichiro Takahashi; Fumihiro Gotoh, both of Yokohama; Osamu Iwasaki, Tokyo; Masaya Uetuki, Kawasaki, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/647,058

[22] Filed: May 9, 1996

Related U.S. Application Data

[62] Division of application No. 07/991,352, Dec. 15, 1992.

[30] Foreign Application Priority Data

Dec. 19, 1991 [JP] Japan ..... 3-336945

[51] Int. Cl.[6] ..... B41J 2/125

[52] U.S. Cl. ..... 347/49; 347/86; 347/19

[58] Field of Search ..... 347/49, 86, 50, 347/19

[56] References Cited

U.S. PATENT DOCUMENTS

| | | | |
|---|---|---|---|
| 4,148,041 | 4/1979 | Rosenstock | 348/86 |
| 4,571,600 | 2/1986 | Hara | 347/28 |
| 4,577,200 | 3/1986 | Rix et al. | 347/49 |
| 4,577,203 | 3/1986 | Kawamura | 347/30 |
| 4,872,027 | 10/1989 | Buskirk et al. | 347/49 |
| 4,952,947 | 8/1990 | Kyoshima | 347/30 |
| 4,970,533 | 11/1990 | Saito et al. | 347/87 |
| 5,115,275 | 5/1992 | Suzuki | 355/245 |
| 5,138,344 | 8/1992 | Ujita | 347/19 |
| 5,162,817 | 11/1992 | Tajika et al. | 347/7 |
| 5,179,389 | 1/1993 | Arai et al. | 347/7 |
| 5,638,097 | 6/1997 | Takayanagi et al. | 347/19 |

FOREIGN PATENT DOCUMENTS

| | | | |
|---|---|---|---|
| 0143250 | 6/1985 | European Pat. Off. . | |
| 0271090 | 6/1988 | European Pat. Off. | 347/108 |
| 0335699 | 10/1989 | European Pat. Off. | 347/28 |
| 0378240 | 7/1990 | European Pat. Off. . | |
| 412459 | 2/1991 | European Pat. Off. | 347/49 |
| 0496642 | 7/1992 | European Pat. Off. . | |
| 2485991 | 1/1982 | France | 347/86 |
| 3726671 | 7/1988 | Germany | 347/28 |
| 57-100088 | 6/1982 | Japan . | |
| 58-039465 | 3/1983 | Japan | 347/28 |
| 61-141560 | 6/1986 | Japan . | |
| 63-168363 | 7/1988 | Japan . | |
| 234647 | 10/1991 | Japan | 347/49 |
| 2236712 | 4/1991 | United Kingdom | 347/28 |
| WO8907526 | 8/1989 | WIPO | 347/28 |

*Primary Examiner*—Valerie Lund
*Attorney, Agent, or Firm*—Fitzpatrick, Cella, Harper & Scinto

[57] ABSTRACT

An information transmitting mechanism is described for transmitting information of an ink tank of an ink jet recording apparatus to a controller thereof. The recording apparatus performs recording by scanning a carriage on which a recording head and the ink tank are mounted; the ink tank is removably mounted to said recording head. The information transmitting mechanism includes the ink tank and the recording head; in particular, the ink tank has an information mark. The recording head is connected to the ink tank and has a signal terminal making a signal connection with the ink tank and with the controller of the apparatus. The content of the information mark is transmitted to the controller through the signal terminal. The information relating to the ink tank is transmitted to the controller through the head terminal and through the carriage terminal. The information relating to the recording head is transmitted to the controller through the carriage terminal.

7 Claims, 13 Drawing Sheets

INK JET RECORDING MEANS AND PACKAGING THEREFOR

This application is a division of application Ser. No. 07/991,352 filed Dec. 15, 1992.

BACKGROUND OF THE INVENTION

1. Field of the Invention

The present invention relates to ink jet recording means in which a recording head unit for effecting recording by ink discharge and an ink tank unit containing ink to be supplied to said recording head unit are integrally constructed at use and in which said ink tank unit can be separated for replacement when necessary, and a packing therefor.

2. Related Background Art

Conventional ink jet recording apparatus is usually provided with a semi-permanently usable head (hereinafter called permanent head), and an ink cartridge which is interchangeably fitted on a device for ink supply to said permanent head through a tube extended in the recording apparatus. In such permanent head, however, the reliability of the recording apparatus is insufficient as it is difficult to completely avoid eventual failures such as nozzle blocking with dust or the time-dependent failures resulting for example from deterioration of the ink discharge element. and These has therefore been required a particular maintenance service system for maintaining recording performance.

On the other hand, for the purpose of improving reliability and cost reduction, there have been commercialized ink jet recording apparatus employing an interchangeable recording head cartridge (hereinafter called disposable head) in which an ink tank and a recording head are integrally constructed, thereby achieving the replacement of the recording head at a predetermined interval after using a predetermined ink amount.

However, a disposable head is higher in running cost than permanent head and has to be disposed of when the ink is used up even if the head still has sufficient performance. That is, since the usable amount of ink in such a disposable head cannot be made large for the purpose of securing the reliability and also in consideration of the size and weight of the disposable cartridge itself. In particular, the disposal of the head cartridge may have adverse ecological consequences which have caused stronger worldwide concern in recent years.

For this reason there has recently been proposed a cartridge configuration in which a recording head unit and an ink tank unit are rendered separable, said units being integrally united at the use but independently replaced when the ink is used up, thereby maintaining the advantage of the disposable head in terms of reliability while reducing running cost and giving consideration to ecological issues.

Such an ink cartridge, however, is associated with the drawback of evaporation of the ink filled in the ink tank, in the course of distribution, and there have been proposed configurations for preventing such ink evaporation in the ink tank, by forming the ink tank with metal or providing the ink tank with metal plating, as disclosed, for example, in the Japanese Patent Laid-Open Application No. 57-100088.

Also the recording head has been associated with a drawback of deterioration of the bubble generating property, giving rise to deteriorated print quality, resulting from contamination of the heater surfaces of the recording head by the ambient conditions, if the recording head is left without ink in the prolonged storage of the head or in the course of distribution.

Also, in such independently replaceable recording head and ink tank, the recording head has a limit in service life, beyond which the recording quality becomes deteriorated for example by the breakage of the heat generating resistors.

It is therefore extremely desirable to render the service life of the recording head easily understandable to the user.

SUMMARY OF THE INVENTION

In consideration of the foregoing, an object of the present invention is to improve the storage performance of the recording head in the prolonged storage such as in the distribution, and to eliminate the limitations in the distribution thereof, thereby increasing the freedom of handling.

Another object of the present invention is to achieve use of the recording head matching the service life thereof, thereby attaining stable recording.

The above-mentioned objects can be attained, according to the present invention, by ink jet recording means in which a recording head unit for effecting recording by ink discharge and an ink tank unit, containing ink for supply to said recording head unit, are integrally combined at the use but said ink tank unit can be separately replaced when required, wherein said recording head contains, prior to the initial use, ink for storage which is not used for the recording.

Also the above-mentioned objects can be attained, according to the present invention, by ink jet recording means in which a recording head unit for effecting recording by ink discharge and an ink tank unit, containing ink for supply to said recording head unit, are integrally combined at the use but said ink tank unit can be separately replaced when required, wherein, in the distribution, said recording head unit contains, prior to the initial use, ink for storage which is not used for the recording, and said recording head is contained in a package together with plural ink tank units containing recording ink which matches the service life of said recording head unit.

The recording head unit is filled with the ink for storage in the course of the distribution, and the interior of the head is replaced by the recording ink at the initial mounting of the recording head. It is therefore rendered possible to effectively present the bubble generation or the nozzle blocking by the precipitation of ink components, often encountered if the recording head is filled with the recording ink in the course of distribution.

DETAILED DESCRIPTION OF THE PREFERRED EMBODIMENTS

Now the present invention will be clarified in detail by preferred embodiments thereof shown in the attached drawings.

Figure 1:
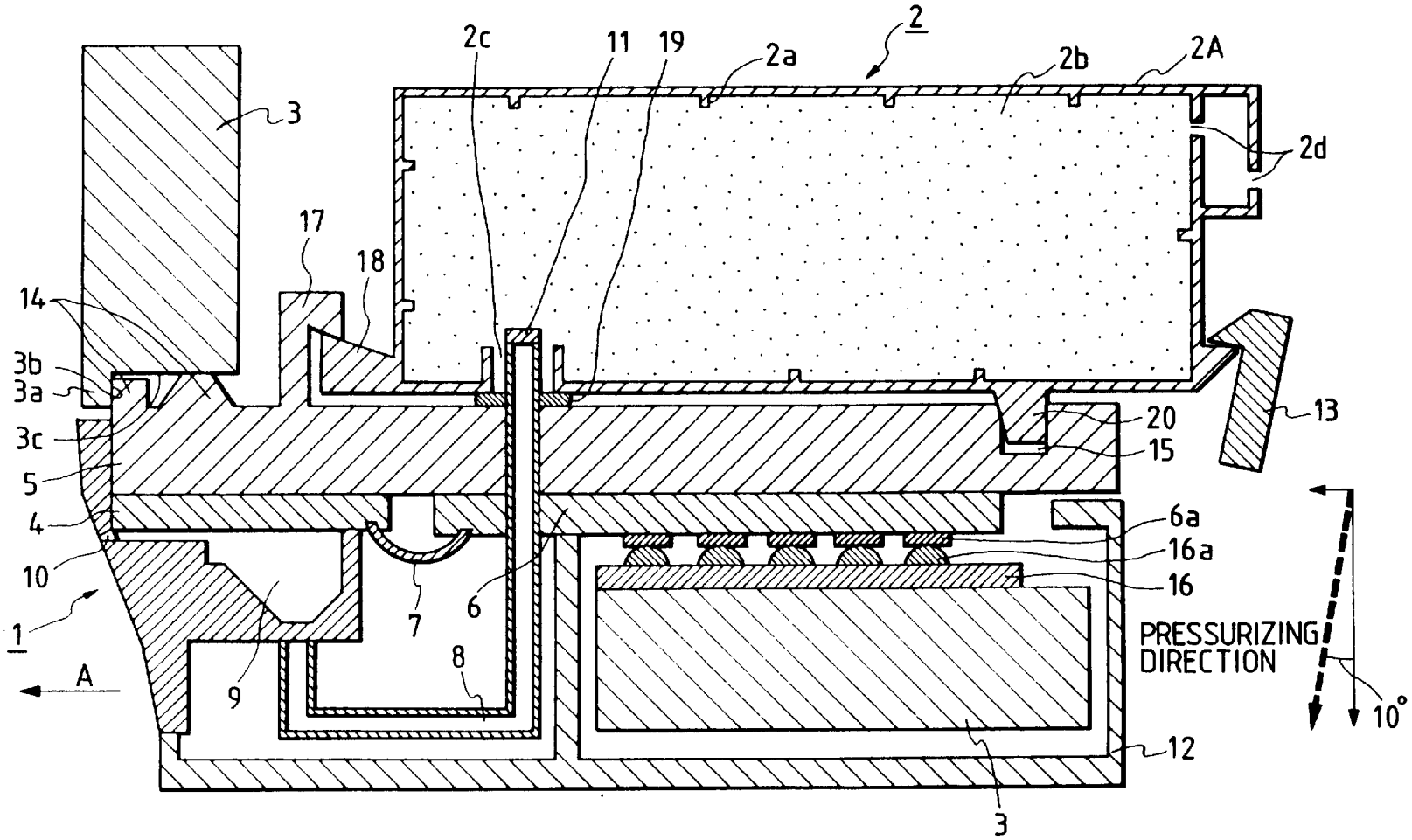
FIG. 1 is a cross-sectional view, showing the mounting state of a replaceable recording head and a replaceable ink tank, embodying the present invention, to a main apparatus.

The recording head of the present embodiment is of the ink jet recording method employing an electrothermal converter element for generating, in response to an electrical signal, thermal energy for inducing film boiling in the ink. Referring to FIG. 1, main components of the recording head 1 are adhered or pressed onto a head base plate 5. utilizing positioning projections and recesses formed on said head base plate 5. A heater board 4 bears, on a silicon substrate, an array of plural electrothermal converter elements (ink discharge heater) and electric wirings composed for example of aluminum for supplying electric power to said heaters, both being formed by film forming technologies, and is connected, by wire bondings 7, to a head PCB (printed circuit board) 6 provided at an end thereof with pads 6*a* for receiving electrical signals from the main body. Ink is supplied from an ink tank 2*a* through an ink supply path 8 into plural ink paths defined by partition walls, respectively corresponding to the discharge heaters. A common liquid chamber 9 and orifices constituting plural ink discharge openings are integrally formed in a grooved plate 10, for example of polysulfone resin, which is pressed to the heater board 4 by unrepresented springs and hermetically sealed thereto with a sealing agent. The ink supply path 8 fixed to said grooved plate 10 is, in the present embodiment, guided through a hole in the head PCB 6 and the head base plate 5 for coupling with the ink tank 2 and is adhered to the head base plate at the penetrating portion. At an end of the supply path 8, coupled with the ink tank 2, there is provided a filter 11 for preventing the intrusion of dust and bubbles into the ink discharge part. A head cover 12 is provided for protecting the ink discharge part of the recording head 1 and the pads 6*a* for electric connection, and for facilitating the handling of the recording head.

A replaceable ink tank 2 is composed of a tank case 2A with internal ribs 2*a*, which is substantially entirely filled with an ink absorbent member 2*b* impregnated with ink, and is provided with an ink supply hole 2*c* for accepting and coupling with the end of the supply path 8 equipped with the filter 11, and an externally communicating hole 2*d* for introducing air into the ink tank in compensation for the outflow of ink thereby preventing generation of an excessive negative pressure. In order to prevent direct communication of the supply part to the external air along the internal wall of the tank case and to maximize the utilization of the ink in the entire absorbent member by capillary action, the ribs 2*a* are provided on the internal wall of the tank and the externally communicating hole 2*d* is positioned distant from the ink supply part 2*c*. The ribs 2*a* also mechanically reinforce the tank case 2A, thereby improving the handling performance at the ink tank replacement. The ink amount initially impregnated in the ink absorbent member 2*b* is selected less than the maximum absorbable amount therein, for a functional purpose of giving a negative water head pressure to the meniscus of the discharge opening when coupled with the recording head 1, thereby enabling stable ink discharge, and for a handling purpose of preventing ink leakage even under a shock at the ink tank replacement. The ink leakage from the externally communicating hole 2*d* may also be prevented by ink-repellent treatment applied to the ink absorbent member at said communicating hole 2*d*, or by employing another ink-repellent absorbent member at said hole 2*d*.

The ink supply from the ink tank 2 reaches the limit when the suction force of the ink absorbent member 2*b* becomes stronger, with the decrease of ink amount impregnated therein, than the ink supply ability to the recording head 11 by the capillary force of the nozzles resulting from the ink discharge, or when air introduced from the communicating hole 2*d* is accumulated around the filter 11 and is supplied in a large amount through said filter 11.

The coupling of the recording head 1 and the ink tank 2 is achieved, as shown in FIG. 1, by the coupling of the recording head unit 1 to a carriage 3 and by a biasing force of a pressurizing hook 13 of the carriage 3.

Figure 4:
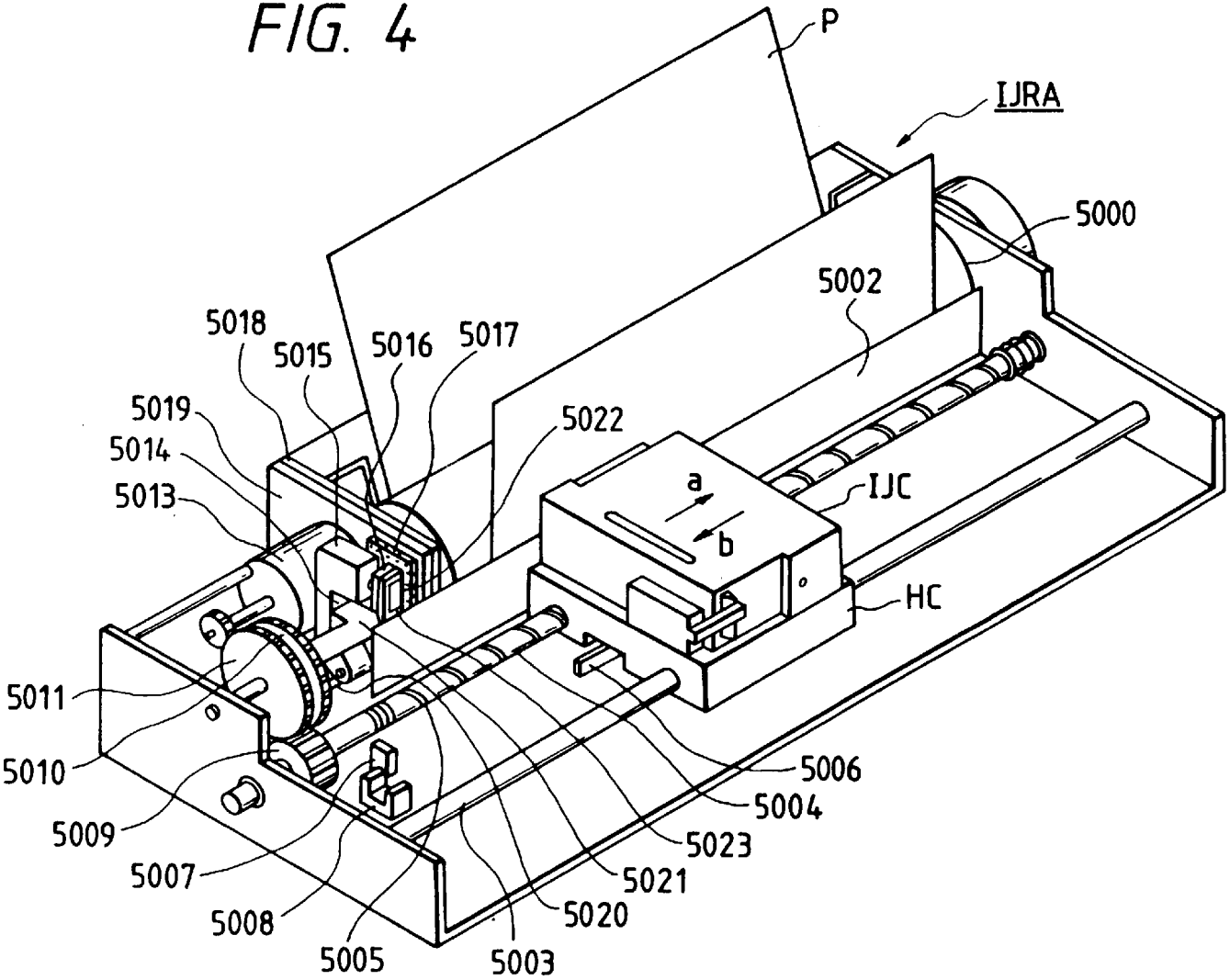
FIG. 4 is a schematic perspective view of an ink jet recording apparatus in which the present invention is applicable.

Now reference is made to FIG. 4, for briefly explaining the position and function of the recording head 1 in the recording apparatus. A recording medium P is guided by a platen roller 5000 from below to above, and is pressed to said platen roller by a pressure plate 5002, along the moving direction of the carriage. The carriage HC, being supported by a lead screw 5005 having a spiral groove 5004 engaging with a carriage drive pin and serving as a driving source by rotation thereof, and by a slider 5003 positioned parallel to said lead screw, reciprocates laterally along the recording face of the recording medium P positioned on the platen roller 5000. Said lead screw 5005 is rotated through transmission gears 5011, 5009, by the forward or reverse rotation of a driving motor. Photocouplers 5007, 5008 constitute home position detecting means, for detecting the presence of a carriage lever 5006 thereby switching the rotating direction of a motor 5013. Image recording signals are supplied to the recording head, in synchronization with the movement of the carriage supporting the recording head, and effect recording at desired positions. A support member 5016 supports a capping member 5022 for capping the front face of the recording head, and suction means 5015 effects suction through an aperture 5023 in the cap, thereby restoring the discharge function of the recording head. A cleaning blade 5017 is projected or retracted by a member 5019 which is supported by a support plate 5018 of the main body. The suction means, blade etc. are not limited to the illustrated form but can naturally be of any already known form. A lever 5012 for determined the timing of the suction moves together with the movement of a cam 5020 engaging with the carriage, whereby the driving force of the motor is controlled by known transmission means such as a clutch. These recovery means are so constructed that desired recovery operations are conducted at predetermined timings by the function of the lead screw 5005 when the carriage is brought to a home position area. The mechanical and electrical connections to the carriage HC are conducted in the following manner.

The carriage HC is composed of a front plate positioned at the platen side (front side of the head), an electrical connection support plate 16 including a flexible plate provided with head drive electrodes 16*a* corresponding to the pads 6*a* on the head PCB and a rubber pad for generating an elastic force for pressing said flexible plate from the rear side thereof, a head positioning area for mechanically fixing the recording head, and a pressurizing hook 13 for supporting the ink tank 2 and the recording head 1 under a biasing force in a direction A. The front plate is provided with two positioning reference faces 3*b*, 3*c*, respectively corresponding to the aforementioned positioning projections 14 provided on the head base plate 5. Since the pressurizing hook 13 of the carriage 3 is so constructed as to generate the biasing force in the pressurizing direction shown in FIG. 1, namely a direction inclined by about 10°0 from the moving direction of the carriage, the recording head is pressed by said biasing force in two directions toward the front plate 3*a* and toward the electrical connection support plate 16. At the same time, the head positioning area is biased in the moving direction of the carriage, about the electric connection support plate 16. The engaging operation of said pressurizing hook may be of any type, but is preferably achieved from the upper side, for example with a lever. In any case, at the engagement of said pressurizing hook, the recording head and the replaceable ink tank rotate slightly on the carriage HC, and the electrical connections are made after the positioning projection and recess contact the reference face 3*b* of the front plate, so that the pads 6*a* on the head PCB are also securely aligned with the head driving electrodes 16*a*.

Figure 2:
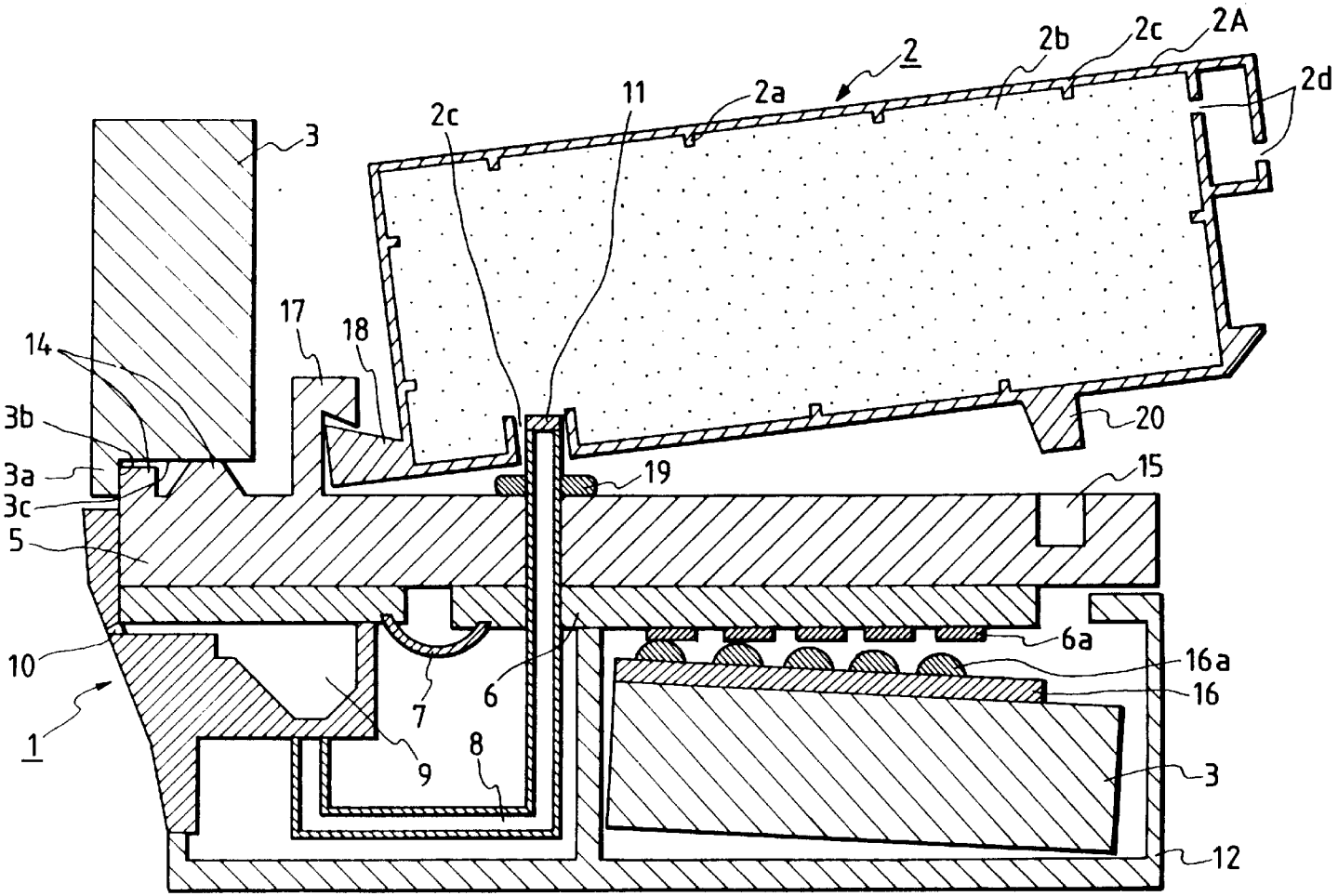
FIG. 2 is a cross-sectional view, showing the mounting step of the replaceable recording head and the replaceable ink tank.
Figure 3:
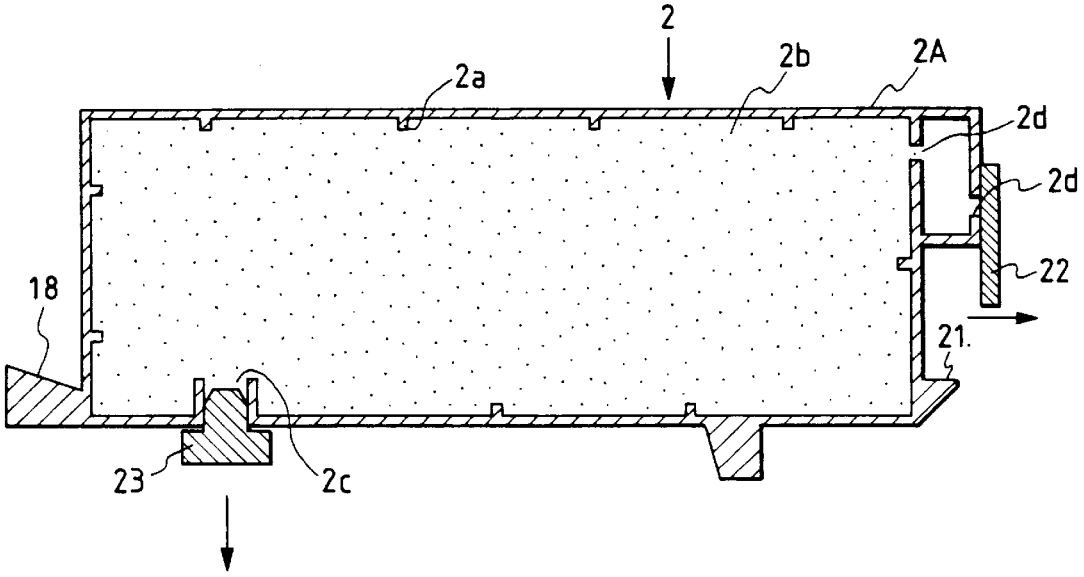
FIG. 3 is a schematic cross-sectional view of a replaceable ink tank.

The recording head 1 and the ink tank 2 are coupled, as shown in FIG. 2, by the biasing force of a tank band (not shown), which is fixed at an end to the head base plate 5 of the recording head 1, extended along the outer wall of the replaceable ink tank 2 in the vicinity of the coupling area thereof and provided at the other end with a tank band spring whose ring-shaped end hook engages with a projection for said band, provided on the head base plate 5. More specifically the coupling of the replaceable ink tank 2 can be made outside the carriage, as shown in FIG. 3. At first a tank guide 20 of the ink tank 2 is fitted into a tank guide hole 15 of the head base plate 5. By positioning this engaging part close to the action point of the pressurizing hook 13 of the carriage 3 and by separating the ink supply part 2*c* as far as possible from said action point of the pressurizing hook 13, it is rendered possible to reduce the amount of the pressure on the ink supply part 2*c* when the carriage is loaded, and to achieve secure coupling of the ink supply path. As will be apparent from FIG. 2, with respect to the coupling between the recording head 1 and the replaceable ink tank 2, the pressure of the pressurizing hook 13 on the replaceable ink tank 2, inducing a clockwise rotation thereon about the engaging point of the tank guide 20, acts on the ink supply part 2*c*, thereby generating a force hindering the coupling thereof. In said ink supply part 2*c*, the force of the tank band couples the ink absorbent member 2*b* and the filter 11 under pressure, thereby connecting the ink supply path, and causes an elastic ring seal 19, sandwiched between the head base plate 5 and the outer wall of the replaceable ink tank, to deform under pressure, thereby completely sealing the interior of the ink tank from the exterior at the ink supply part 2*c*. If said sealing is incomplete, the air introduction into the ink tank as a result of ink supply to the recording head 1 takes place directly in this part, instead of through the ink absorbent member 2*b*, whereby the effective utilization of the ink impregnated in the ink absorbent member 2*b* becomes difficult.

In the present invention, however, secure ink path connection can be achieved even at the mounting on the carriage, since the coupling force by the tank band spring at the ink supply part is selected larger than the force of the pressurizing hook 13.

As explained in the foregoing, the pressurizing hook 13 has a pressurizing direction inclined by 10°0 in order to define the position of the recording head 1 toward the paper with respect to the carriage, and said pressurizing hook 13 can be engaged more easily, as in the present invention, with the replaceable ink tank 2 with a relative large tolerance, rather than with the head base plate 5, as the form of said head base plate 5 has to be complicated. At the same time, in the coupling between the recording head 1 and the replaceable ink tank 2, there is applied a force perpendicular to the coupling direction, but, in the present embodiment, said force is received by the engagement of the tank guide and the tank guide hole 15 as shown in FIG. 1. More specifically, the tank guide 20 is in contact with an internal wall of the tank guide hole 15, and, under this contacting force, the recording head 1 is positioned with respect to the carriage 3 at the head positioning part 14. In the present embodiment, in order to avoid unnecessary mechanical force to the ink path 8 which is directly connected to the ink discharge part, requiring a particularly high precision in the recording head 1, the play of the ink path 8 in the ink supply part 2*c* in the replaceable ink tank 2 is selected larger than that of the tank guide 20 in the tank guide hole 15, whereby all the force perpendicular to the coupling direction of the ink tank 2 is received by the coupling part of the tank guide 20. In the present embodiment, the contacting part of the tank guide 20 also serves to prevent the rotation of the ink tank 2 on the head base plate 5, and the plays of the components on this rotating plane are similarly designed to avoid unnecessary force to the ink path 8.

The ring seal 19 in the present embodiment is composed of a rather thick elastic ring, in order to form a broad contact area with the outer wall of the ink tank thereby accommodating the play in the ink supply part 2*c*.

In the present embodiment, as explained with reference to FIGS. 1 and 2, the recording head 1 and the replaceable ink tank 2 are approximately coupled on the carriage 3 and then the ink tank 2 is biased in a direction, whereby the positioning and coupling of the carraige 3 and the recording head 1 and the coupling of the recording head 1 and the replaceable ink tank 2 can be securely and simultaneously attained. Also in the present embodiment, the electrical connections between the carriage (main body of the recording apparatus) 3 and the recording head 1 are made at the same time, so that satisfactory operability can be realized at the replacement of the recording head and the ink tank, but it is also possible to effect the electrical connections for example by a separate connector, thereby increasing the freedom in configuration for securer positioning of the recording head and coupling with the replaceble ink tank.

FIG. 3 is a cross-sectional view showing the state of the replaceable ink tank prior to use, wherein detachable sealing members 22, 23 are provided respectively in the externally communicating part 2*d* and the ink supply part 2*c* in order to prevent leakage or evaporation of ink in the course of distribution. At the use of the ink tank 2, said sealing members are to be removed in directions indicated by arrows.

Though the present embodiment has been explained by a mono-color recording apparatus having one recording head 1, it is likewise applicable also to a color ink jet recording apparatus with plural recording heads for inks of different colors, for example with four recording heads for black, cyan, magenta and yellow. It is furthermore applicable to a recording head capable of discharging inks of plural colors, and, in such case, there may be added known means for defining the coupling position and direction of the replaceable ink tanks.

In the above-explained embodiment, the coupling direction between the recording head 1 with carriage 3 is made substantially equal to that between the recording head 1 and the replaceable ink tank 2, and both couplings are made by the biasing on said ink tank 2. Thus there can be attained satisfactory operability at the replacement of the recording head and the replaceable ink tank, and the mechanical and electrical couplings can be attained securely with a simple structure.

FIGS. 6 to 9 illustrate another embodiment of the ink jet recording means of the present invention.

Components same as or equivalent to those in the foregoing embodiment are represented by same numbers, and will not be explained further.

Figure 6:
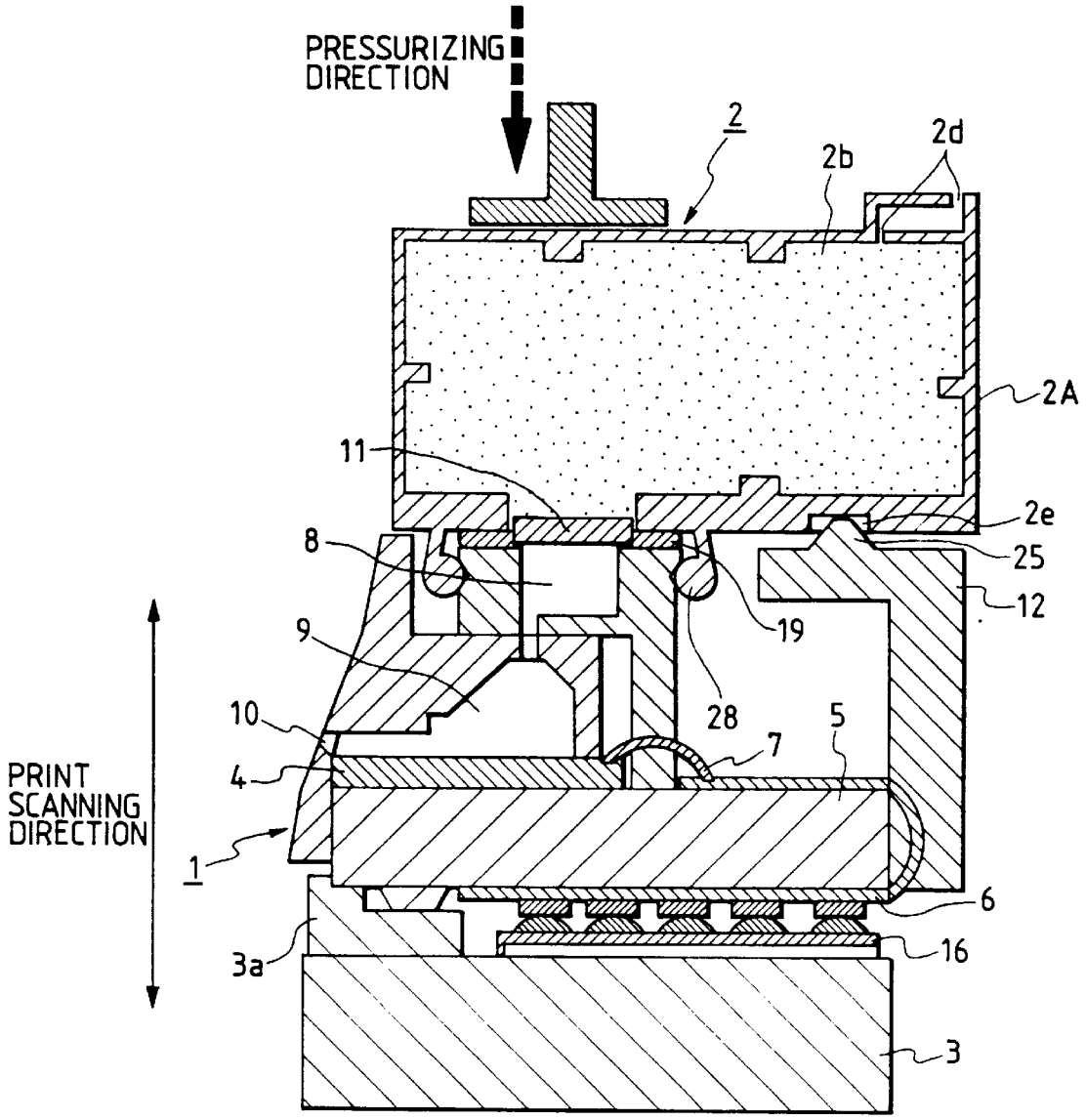
FIG. 6 is a cross-sectional view, showing another embodiment of the mounting state of a replaceable recording head and a replaceable ink tank, embodying the present invention.

In the present embodiment, since the recording head 1 effects scanning motion on the paper surface while discharging ink downwards, the positioning of the recording head 1 with respect to the carriage 3 toward the paper surface is achieved by contacting a notch of the head base plate 5 with the reference face of the carriage, utilizing the weight of the recording head. Also the positioning of the recording head in the scanning direction is achieved, as shown in FIG. 6, by the force of a biasing (pressurizing) member 30 provided on the carriage, said force acting on the recording head 1 through the replaceable ink tank 2, whereby a projecting reference face of the recording head impinges on the reference face 3*a* of the carriage in the head positioning part. Also the electrical connections in the present embodiment is achieved, as in the foregoing embodiment, by the contact of the pads 6*a* of a head flexible board with the head driving electrodes 16*a* on the carriage 3, under the pressure through the replaceable ink tank 2. In the present embodiment, however, the electrical connections to the recording head 1 are provided on a flexible board and contact pads 6*a* are formed on a face of the head base plate opposite to the ink discharge part of the recording head 1, the reliability of connection is improved in comparison with the foregoing embodiment in which the recording head 1 is somewhat rotated in the mounting. Furthermore, in order to avoid inclined mounting of the recording head 1, a positioning reference projection (not shown) is provided in the vicinity of the electrodes at the rear end of the head base plate 5, and a thicker and more elastic member than in the foregoing embodiment is provided under the head driving electrodes in order to obtain an appropriate contact force between the flexible board and the head driving electrodes under the contact of the reference projection, thereby ensuring the connection of electrodes.

In the present embodiment, therefore, the pressure acting on the recording head 1 through the replaceable ink tank 2 is received by reference projections provided at the front and at the rear of the head base plate 5.

The ink path in the present embodiment is provided, different from the foregoing embodiment, directly above the liquid chamber and is connected to the replaceable ink tank at the ink discharge side of the head base plate. Since it does not penetrate through the head base plate, it can be easily shorter and thicker, whereby the fluid resistance in the ink path can be made smaller than in the foregoing embodiment. It is therefore possible to increase the recording frequency, as the pressure loss at the ink supply to the recording head is reduced. On the other hand, as the pressure at the coupling of the ink tank 2 and the recording head 1 may more easily affect the ink discharge part through the ink path, the members constituting the ink path of the present embodiment are reinforced in mechanical strength, while the ink path is directly fixed to the head base plate, and hermeticity at the connection between the ink path and the liquid chamber is ensured by a sufficient amount of the sealing agent. Also, as the recording head of the present embodiment is constructed by laminating the heater board and the grooved plate on the head base plate, it is possible also to increase the binding force of these components while regulating the pressure, acting through the replaceable ink tank, to a suitable value.

Figure 7:
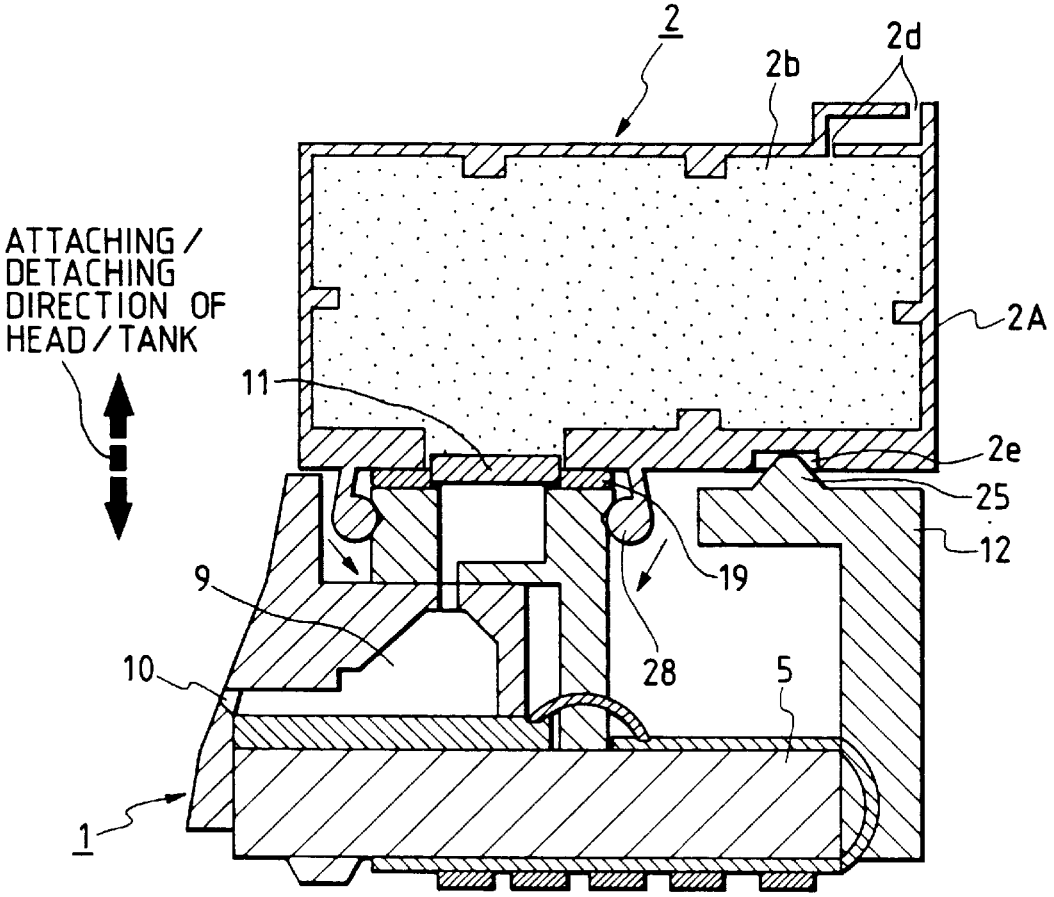
FIG. 7 is a cross-sectional view, showing the coupling state of the replaceable recording head and the replaceable ink tank shown in FIG. 6.
Figure 8:
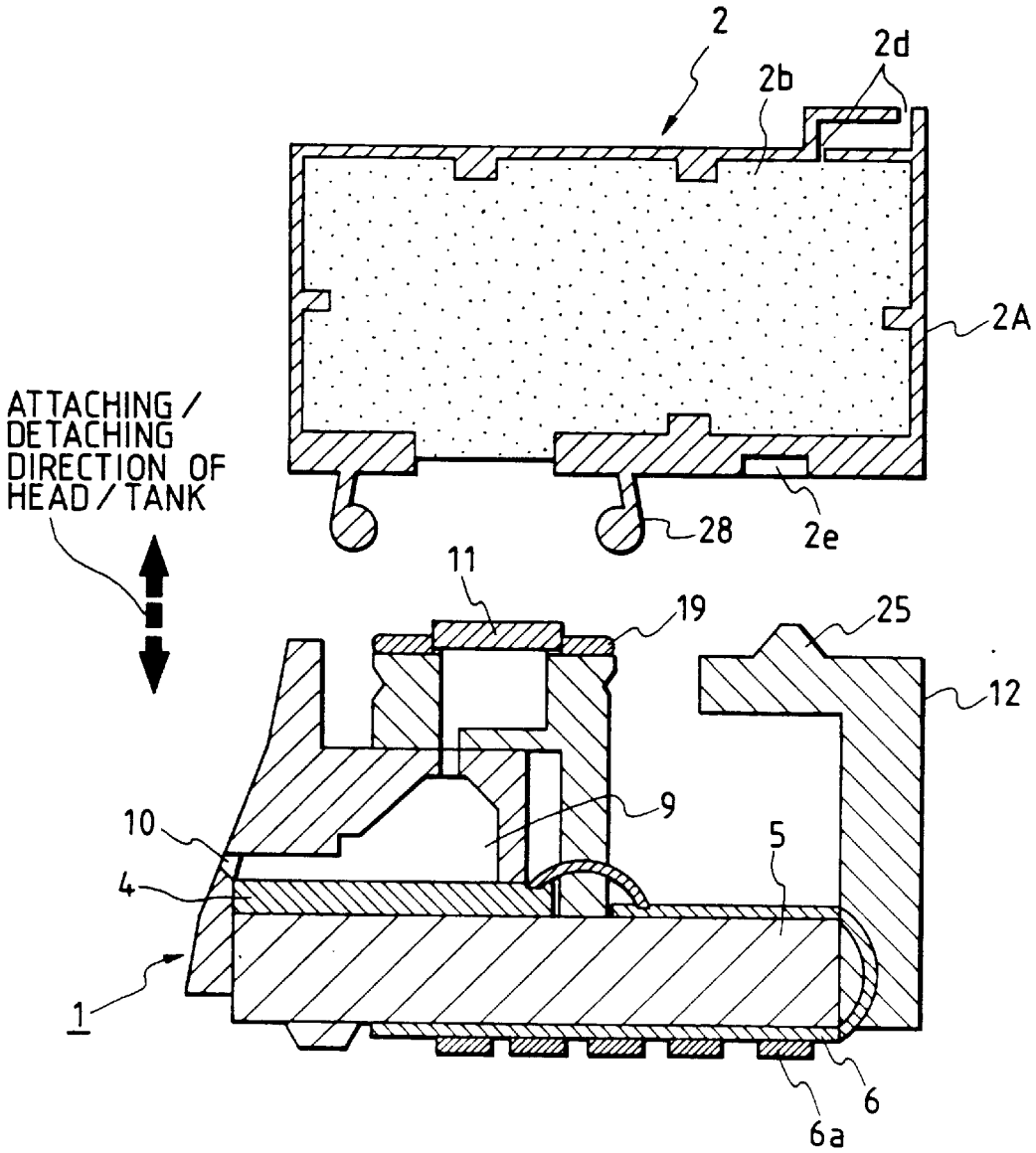
FIG. 8 is a cross-sectional view, showing the replacing procedure of the replaceable recording head and the replaceable ink tank.

Now the attachment and detachment of the recording head and the replaceable ink tank of the present embodiment will be explained with reference to FIGS. 6 to 8. As shown in FIGS. 7 and 8, the recording head and the ink tank of the present embodiment may be coupled or disassembled while they are taken out from the recording apparatus. Naturally the attachment and detachment may be conducted on the carriage, by providing the carriage with auxiliary means for facilitating such operations.

The mounting of the recording head and the replaceable ink tank is conducted, utilizing a tank guide 25 and engagement guides 28 of the ink supply part, so as to reach a state shown in FIG. 6, from a state shown in FIG. 7. The tank guide 25 serves to approximately limit the rotation of the replaceable ink tank 2 on the recording head 1, but has a certain play, in order not to hinder the coupling action of the engagement guides 28 at the ink supply part. The coupling at the ink supply part is achieved by engagement of elastically deformable engagement guides, provided on the replaceable ink tank, with a recess formed in an ink path constituting member supported by the head base plate 5 of the recording head. For this purpose, the front ends of the engagement guides 28 are rounded. In the present embodiment there are provided through engagement guides 28 (one being not shown), for coupling on three points on a cylindrical engaging part of the ink path constituting member. However said engagement guides may be provided in a larger number or united in a cylindrical form, and said engaging part may be non-cylindrical. The elastic force of the engagement guides 28 is not strong, in order to facilitate the attachment and detachment. Consequently, in the state shown in FIG. 7, the coupling at the ink supply part is insufficient, with insufficient deformation and contact of the ring seal 19 and with insufficient contact between the filter and the ink absorbent member, and is merely at such level that the recording head 1 and the ink tank 2 can be integrally handled at the replacement.

The recording head 1 and the ink tank 2, in said insufficiently coupled state, are mounted on the carriage 3 of the recording apparatus as shown in FIG. 6. As explained in the foregoing, the positioning reference 5*a* of the recording head is engaged with the head positioning part 3*a* on the carriage 3, and then the replaceable ink tank 2 is pressed in a direction, indicated by an arrow in FIG. 6, by pressurizing means 30 provided on the carriage 3. Said pressing of the ink tank 2 fixes the recording head 1 to the carriage 3 and achieves complete coupling of the recording head 1 and the replaceable ink tank 2.

More specifically, as shown in FIG. 6, the engagement guides 28 of the ink tank are inserted deeper than the recess in the ink path constituting member, whereby the filter 11 at the end of the ink path comes into sufficient contact with the ink absorbent member in the ink supply part thereby enabling ink supply, and the ring seal is elastically deformed until the outer wall of the ink tank 2 comes into contact with the upper face of end of the ink path thereby completely avoiding the direct contact with the external air at the coupling part.

Figure 9:
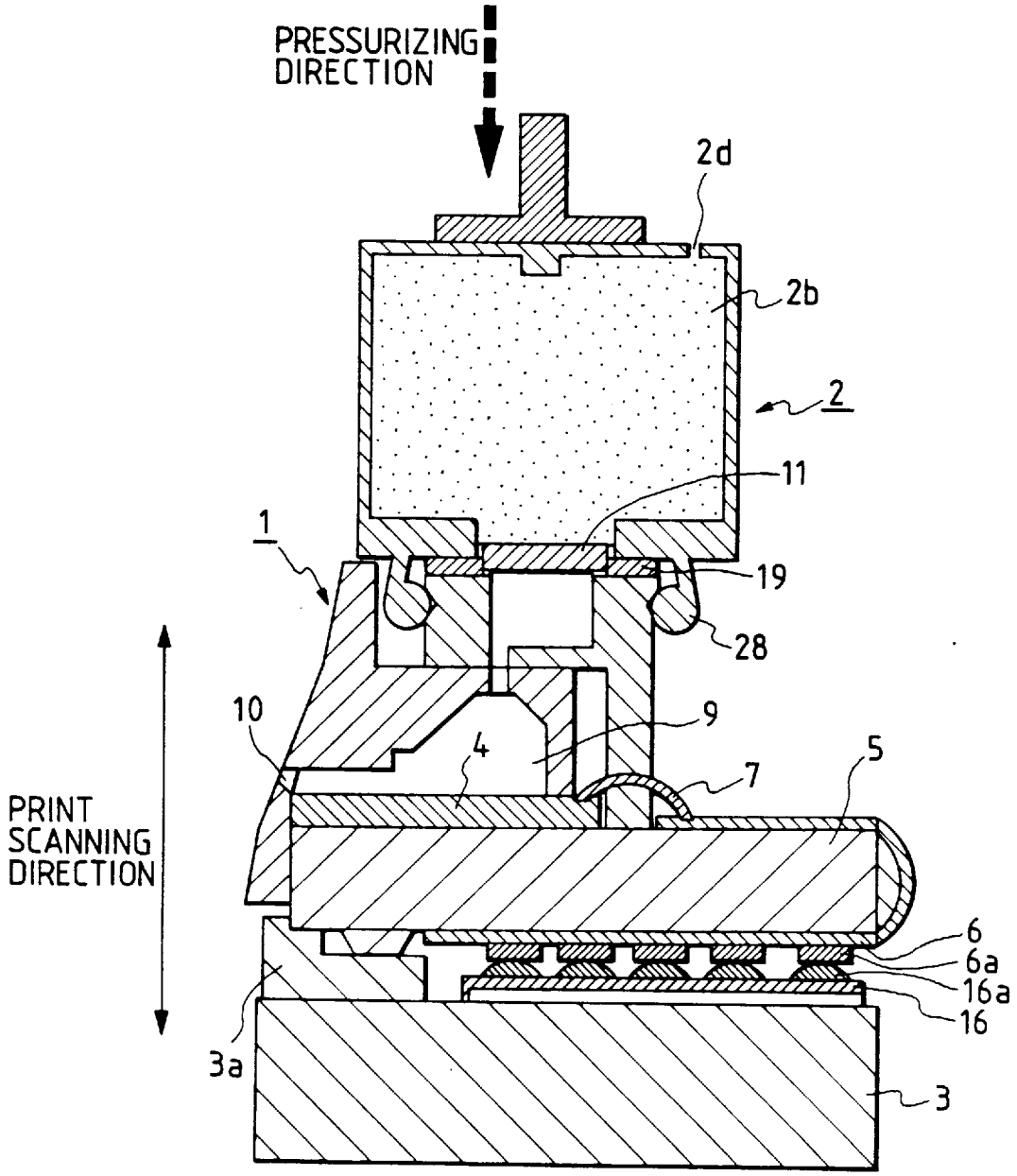
FIG. 9 is a cross-sectional view showing still another embodiment of the mounting state of a replaceable recording head and a replaceable ink tank, embodying the present invention.

The tank guide 25 is so constructed as to leave, even in this state, a sufficient gap in the coupling direction of the recording head and the ink tank, in order to avoid unnecessary force applied to the ink supply part. In this sense, the tank guide may be dispensed with, by forming the ink tank in cylindrical shape as shown in FIG. 9 so as to be rotationally free in the coupling direction on the recording head.

In the present embodiment, as explained in the foregoing, the coupling direction of the carriage and the recording head is selected identical with that of the recording head and the replaceable ink tank, and both couplings are achieved simultaneously by the pressurization on the ink tank. It is therefore rendered possible to attain satisfactory operability of the recording head and the replaceable ink tank at the replacement thereof, and to achieve secure mechanical and electrical couplings thereof with a simple structure. Besides, the handling property at the replacement is further improved, as the recording head and the ink tank are so constructed as to be approximately integrated even when they are not mounted on the carriage.

Figure 10:
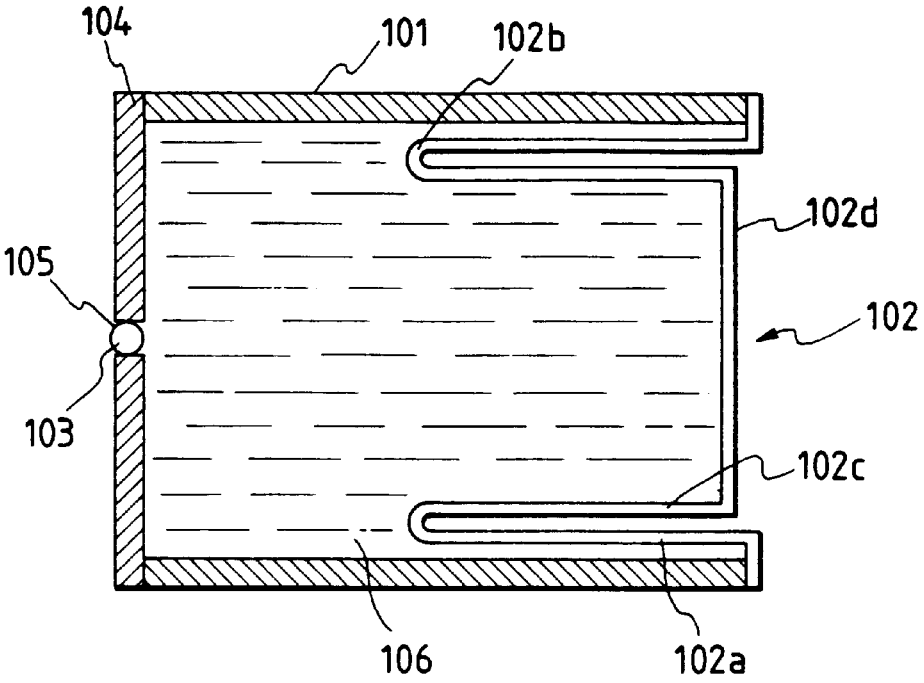
FIG. 10 is a schematic cross-sectional view showing another embodiment of the replaceable ink tank.
Figure 11:
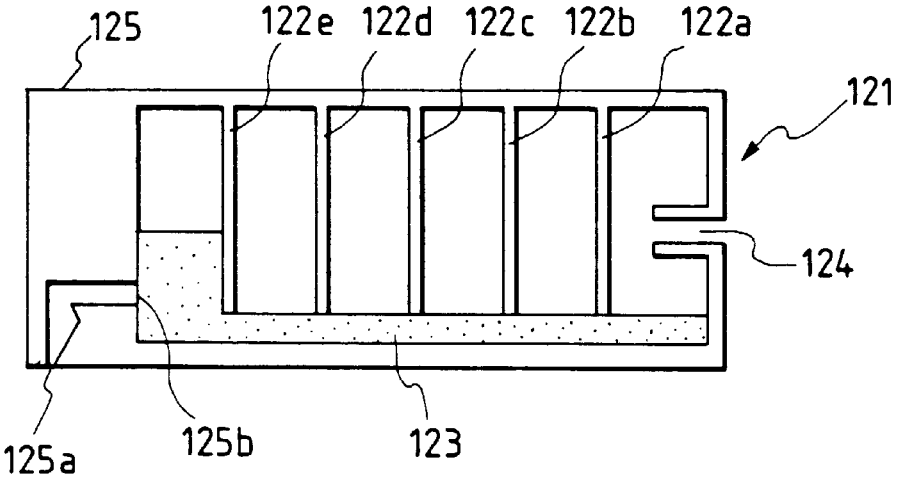
FIG. 11 is a schematic cross-sectional view showing still another embodiment of the replaceable ink tank.

Also the ink tank in the present embodiment may be entirely filled with the ink, without the ink absorbent member, as shown in FIGS. 10 and 11.

The ink tank shown in FIG. 10 is composed of cylindrical tube 101 of which an end is closed by a bottom plate 104 and the other end is closed by a flexible member 102 made for example of rubber or soft plastic material. The bottom plate 104 is provided with an ink discharge opening 105, which is closed by a ball when not in use. The interior of the ink tank is filled with ink 106.

Said flexible member 102 is composed of an outer wall portion 102*a* fixed at the periphery to the end face of the aperture of the cylindrical tube 101 and extending along the internal wall thereof from said periphery, a bent portion 102*b* folded in the opposite direction at the approximate center of the cylindrical tube 101, an internal wall portion 102*c* extending from said bend portion 102*b* to the vicinity of the aperture of the cylindrical tube 101 along said outer wall portion 102*a*, and a disk-shaped bottom wall portion 102*d* connected to said inner wall portion 102*c*. FIG. 10 is merely a schematic view, and the bent portion 102*b* is not limited to the illustrated shape but also includes a bent form with a relatively large radius of curvature, depending on the properties of the material.

The ink tank 121 shown in FIG. 11 is provided, on a bottom wall 121*a*, with a porous member 123 exemplified by sponge, and is divided, excluding the part of said porous member 123, into six chambers by five partitions 122*a*–122*e*. Said tank may be composed of a material allowing to confirm the interior, and, in such case, the remaining amount of ink can be known by visual inspection. At the approximate center of a rear wall 121*c* of the tank 121, there is provided a tubular externally communicating hole 124. With such configuration, even when the ink accumulates in the chamber of the communicating hole 124, there will not take place the ink leakage regardless of the position of the ink tank as long as the ink amount does not exceed a half of the volume of said chamber.

Figure 5:
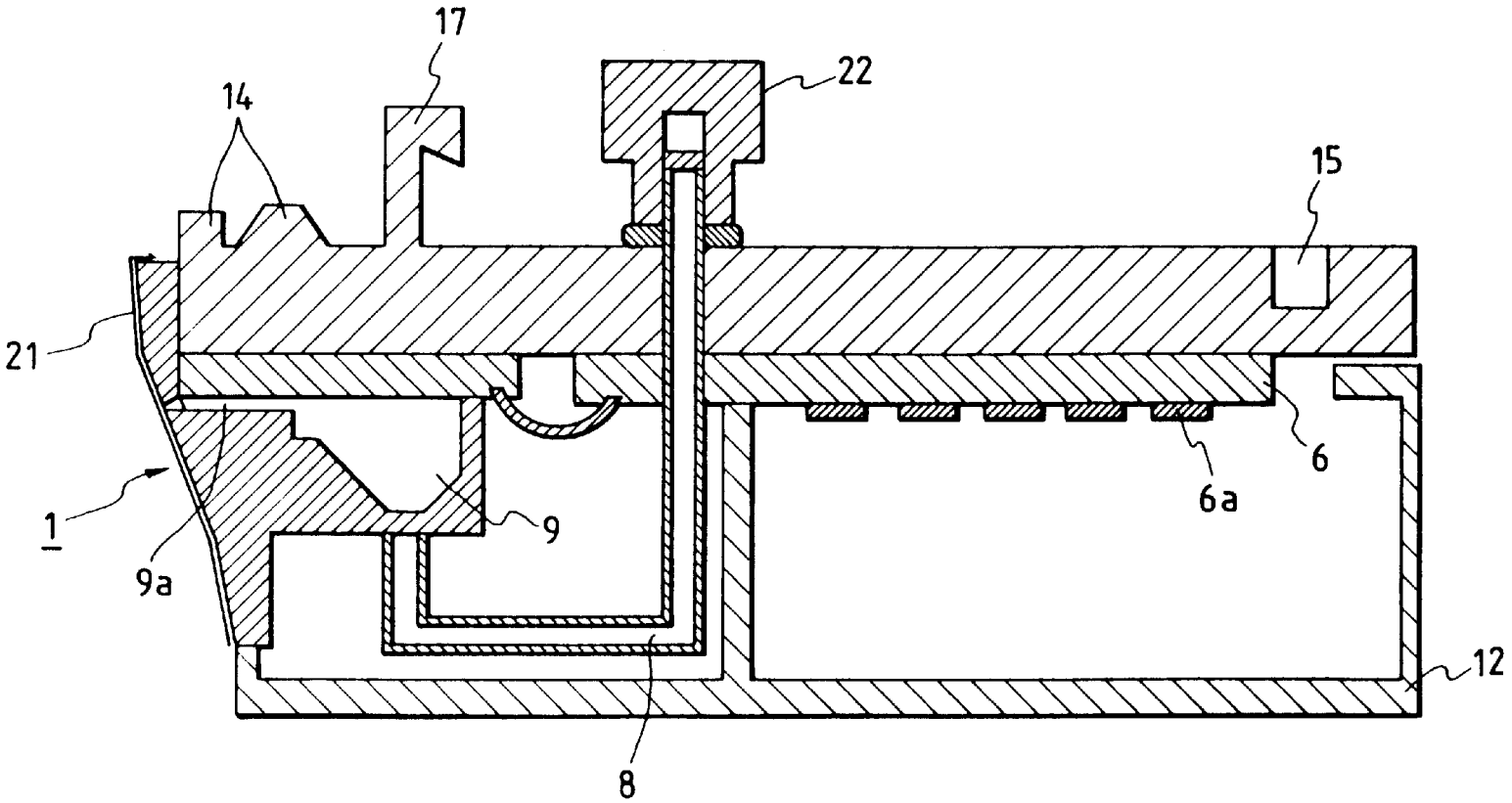
FIG. 5 is a schematic cross-sectional view of a replaceable recording head.

FIG. 5 illustrates the recording head unit 1 employed in the present embodiment. Said recording head unit 1 has a replaceable form, and is filled, when used in the recording, therein with the ink supplied from the ink tank unit 2.

However, in the course of distribution, such recording head unit 1 may be stored for a prolonged period with the empty interior as explained before, and there may result, for example oxidation of heater elements. Stable ink discharge becomes impossible in case of such heater oxidation. Also the service life of the head cannot be sufficiently secured, and the reliability on the service life may also be deteriorated.

In the present embodiment, therefore, there is employed a configuration in which the interior of the recording head unit is filled, in the course of distribution, with liquid, particularly liquid which is not used for recording. Referring to FIG. 5, the liquid paths 9*a* and the liquid chamber 9 are filled with liquid which is utilized for storage and distribution but not used for recording.

In the present embodiment, said filling liquid need only prevent the film contamination caused for example by air, and can be the same ink used in ordinary recording. By such filling with ink equivalent to that used in the recording, the heater elements are covered with said ink and are protected from film contamination. Also such filling with the ink used for recording causes the heater elements to adapt better to the ink, thereby enabling stable ink discharge from immediately after the head replacement.

However, in case the recording ink is filled, coagulation thereof may occur under certain conditions of distribution, for example extremely prolonged storage or storage at a high temperature, and, in such case, it is difficult to attain the desired recording immediately after the head replacement.

Also in case the recording ink is aqueous, the dissolved gas comes out and remains as bubbles in the head in the course of above-mentioned storage, and the recording head, if used for recording in such state, may result in defective ink discharge because of the influence of said bubbles. Also the properties of the internal surface of the recording head may vary between an area contacting the ink and an area contacting the bubbles (latter becoming hydrophobic).

The above-mentioned drawback of bubble formation can be prevented by employing recording ink which is degassed by a known degassing process.

Also against said drawback of bubble information, a satisfactory effect can be obtained with liquid containing water and diethylene glycol as components (namely components remaining after removal of all or a part of dye components from the recording ink). Such liquid, containing water and diethylene glycol, and being free from the dye components of the ink, has the advantage of being not selective to the color of the ink to be filled later. (In case of filling with the recording ink, the ink tank to be connected has to be of the same color).

The liquid filled in the recording head is preferably entirely discharged prior to the initial use of the head after replacement. Particularly the liquid containing water and diethylene glycol should be entirely discharged, and the new introduction of the recording ink allows satisfactory recording in stable manner from the beginning.

In the following there will be explained the discharge of the filled liquid.

Figure 13:
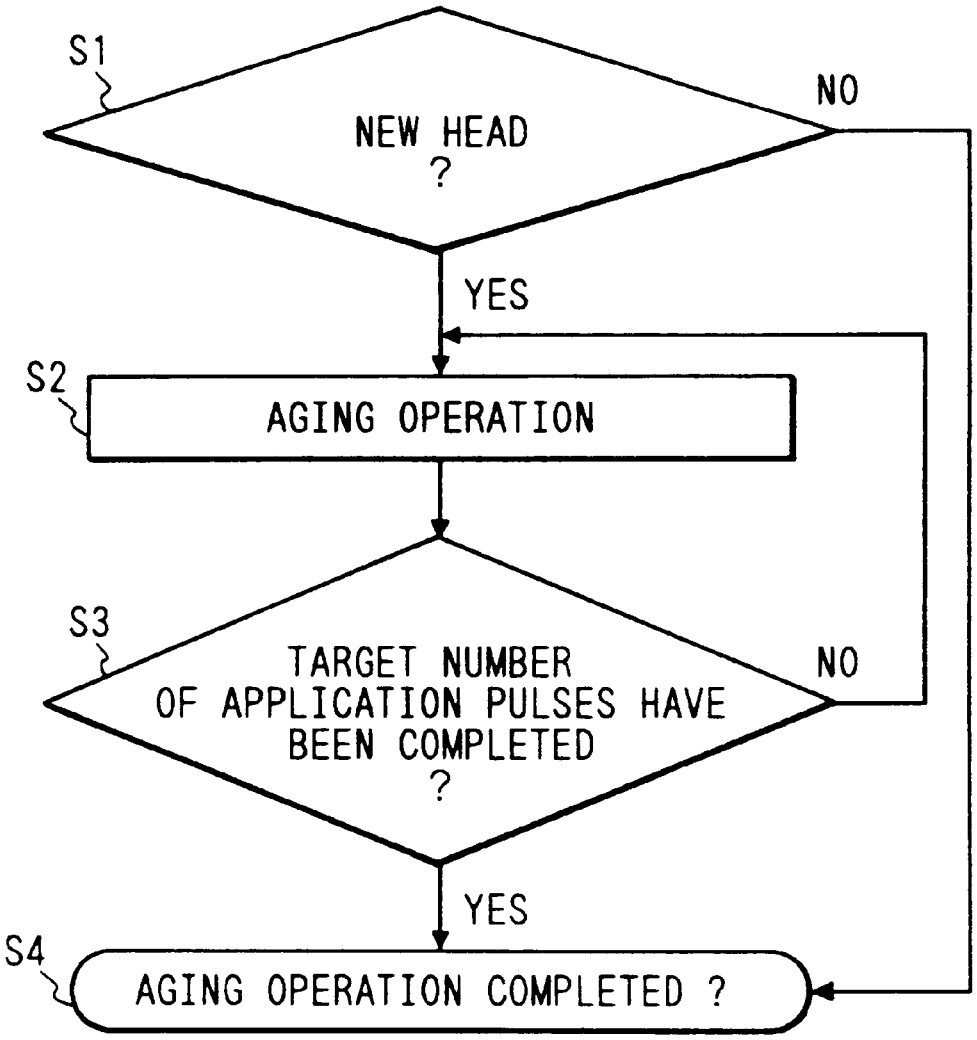
FIG. 13 is a flow chart showing an aging process after the ink replacement.

This method is called aging, in which the discharge heaters of the recording head are given several hundred thousand to several million heat pulses in consecutive manner whereby the oxide films and impurities present on said heaters are peeled off by the bubble generating energy and are discharged from the ink discharge openings. FIG. 13 shows the approximate flow of the aging sequence when the recording head is replaced by a new one. In a step S1, the main body of the recording apparatus confirms, by known recording head detection means, that a new head has been mounted in the main body. When a new head has been mounted, a step S2 starts the aging procedure, thereby discharging the liquid for storage and distribution from the liquid chamber and the liquid paths. A step S3 discriminates whether the number of pulses applied for said discharge has reached a predetermined value, and, when said value is reached, a step S4 terminates the aging procedure.

This method, when applied to the discharge of the liquid for distribution and storage, can effect said discharge as well as the aging of the discharge heaters at the same time. Also said aging procedure, when conducted with the liquid containing water and diethylene glycol, can satisfactorily remove the unnecessary substances deposited on the heaters, thereby activating the heaters in satisfactory manner.

It is also possible to discharge the liquid for storage in the recording head, by means of suction utilizing the discharge recovery device of the recording apparatus, and to fill the recording ink from the ink tank, and the above-mentioned aging procedure may naturally be conducted after the liquid is replaced by the recording ink by said suction.

In the present embodiment, since the ink tank has a capacity of 8 g while the recording head has an ink capacity of 0.1 g, the liquid for storage in the recording head can be securely replaced, without excessive use of the ink of the ink tank. Also each suction operation is designed to suck 0.07 g of ink, so the interior of the recording head can be easily replaced with the recording ink by approximately two sucking operations. As the liquid filled in the course of distribution can be almost completely discharged from the recording head by these operations, stable recording can be attained from the beginning after head replacement.

Figure 12:
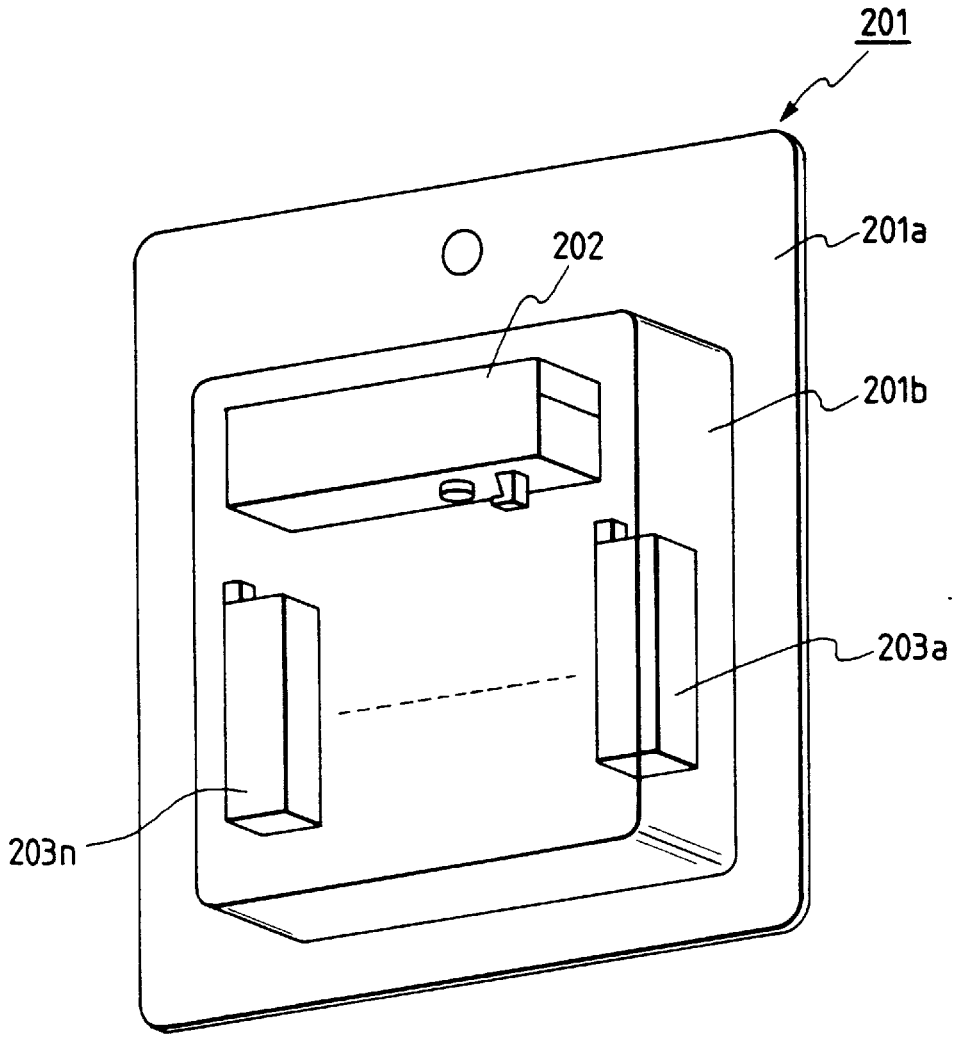
FIG. 12 is a schematic view, showing a package containing replaceable recording head and replaceable ink tanks, embodying the present invention.

In the following there will be explained the form of the above-explained ink jet recording means at the distribution, with reference to FIG. 12.

In case of using a replaceable recording head, it is important to exactly recognize the timing of replacement thereof. When the recorded image becomes deteriorated in quality, it is necessary to identify whether said deterioration is due to the expiration of the service life of the recording head, or is an eventual error that can be restored by the recovery unit incorporated in the recording apparatus. If it is a restorable image deterioration, the image quality has to be restored by the recovery unit. On the other hand, in the case of image deterioration due to the expiration of the service life of the recording head, the recovery operation will be useless, merely resulting in the waste of the recording ink. The present embodiment is capable of clearly indicating the service life of the recording head, by placing the replaceable recording head and the recording ink in a same package. Said package contains a replaceable recording head and plural replaceable ink tanks (containing the recording ink). If the recording head has a service life corresponding to 2000 sheets of recording media and if the replaceable ink tank has an ink capacity capable of recording 400 sheets, 5 ink tanks correspond to the service life of the recording head. Thus, by placing a recording head and five ink tanks in said package, the user can easily recognize the service life, or the timing of replacement, of the recording head.

The number of ink tanks per package naturally varies according to the service life of the recording head and the number of recordable sheets per ink tank.

In an alternative form, the replaceable recording head is filled with the liquid for storage and distribution, while the replaceable ink tanks are filled with inks of respectively different colors. In this case the recording head is not specified by color, and the ink tanks alone are specified by colors. In this manner the recording head can be handled without limitation by color, at the mounting of a new head or at the distribution, so that the adaptability is extremely expanded.

In such case, it is also possible to use different inks with the same recording head, by including a cleaning ink tank in the package, for cleaning of the interior of the recording head.

Also in the present embodiment, the ink tanks in a package may be numbered in positions easily recognizable from the outside. Such numbering allows the use to easily recognize the sequential number of the ink tank currently in use. In addition, there may be provided information indexes 203A, . . . , 203N for transmitting said number or the characteristics of the contained ink to the recording apparatus or to the recording head. The transmission of such number or characteristics of the ink tank allows to create a matching recording state, or the recording apparatus may generate an alarm by detecting the service life of the recording head, based on the number of the used ink tank.

Figure 14:
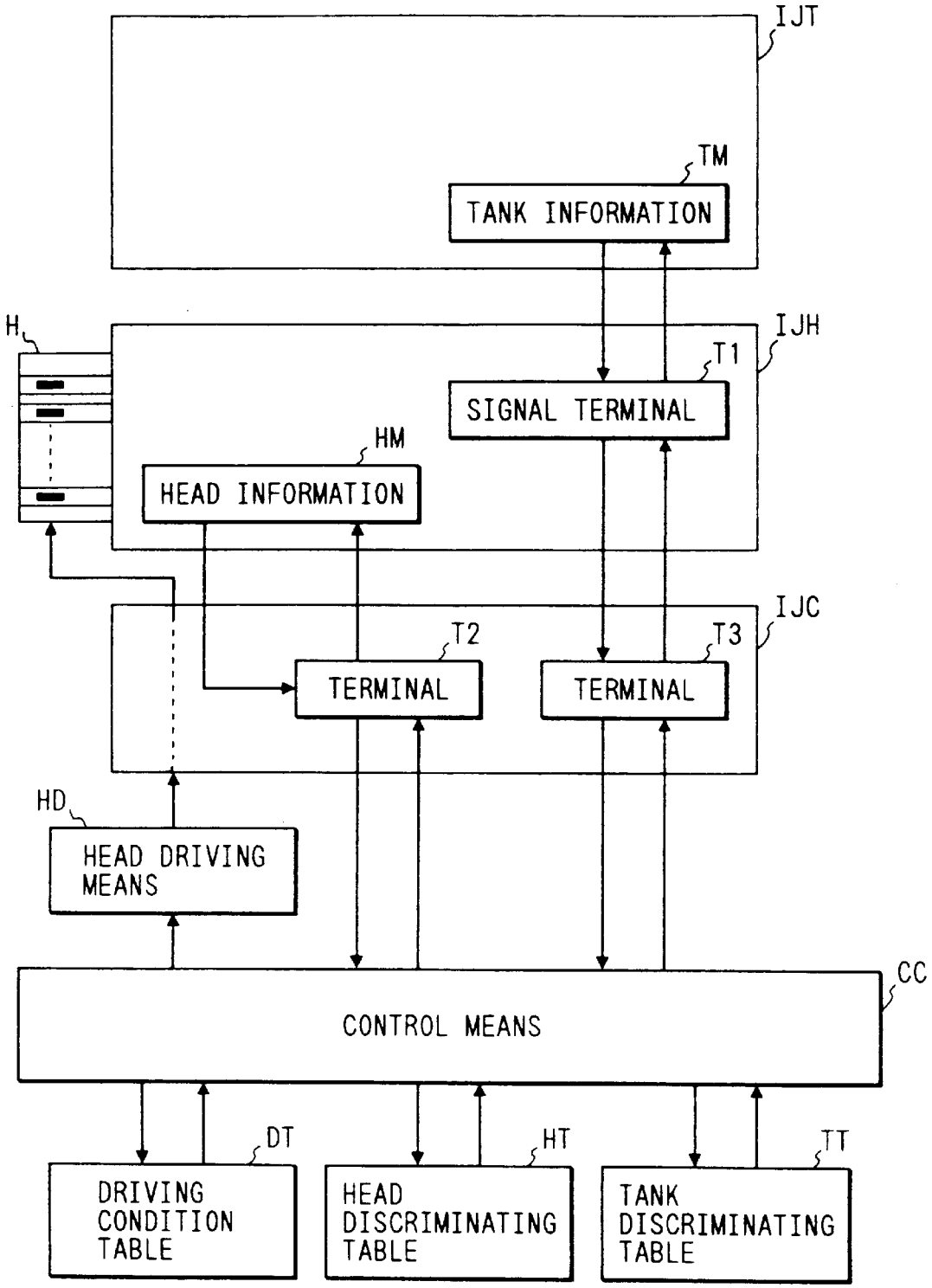
FIG. 14 is a block diagram, showing the information exchange of the replaceable recording head and the replaceable ink tank with the main body of the recording apparatus.

In case the ink tanks are provided with the information indexes 203A, . . . , 203N, the apparatus can be constructed as shown in FIG. 14. As shown in FIG. 14, utilizing ink tank information means TM and a signal terminal T1 provided on the recording head for reading said information, it is transmitted to control means CC in the main body. The transmitted information is compared with a table in the tank discrimination means TT provided in the control means for example for recognizing the number of the ink tank, and suitably selecting the corresponding recording condition.

Such information attachment to each ink tank allows to attain the recording optimum for the used ink tank or to attain the recording corresponding to the number of use ink tanks, so that the recording can be made in satisfactory manner without quality deterioration.

As explained in the foregoing, the present invention provides the ink jet recording means with separately replaceable recording head and ink tank, wherein the liquid filled in the recording head is divided into liquid for storage and distribution and ink for recording. In this manner the recording head is relieved from the limitation in used and in distribution, in relation to the color of the ink, and is given a larger freedom of handling.

What is claimed is:

1. A recording mechanism disposed within an ink let recording apparatus which records on a recordable medium and which has a control means, said recording mechanism comprising:

a carriage movably attached to said ink let recording apparatus for scanning said recording medium, said carriage having a carriage terminal for receiving and for transmitting electrical signals, said carriage terminal being in electrical connection with said control means of said ink jet recording apparatus;

a recording head removably mounted on said carriage, said recording head having (i) a head terminal for receiving and for transmitting electrical signals and electrically connected to said carriage terminal, (ii) a discharge mechanism for discharging ink in accordance with a recording signal received from said control means of said ink let recording apparatus by said head terminal through said carriage terminal, (iii) an ink introducing route for introducing ink into said discharge mechanism, and (iv) a head information index that transmits information relating to said recording head and that is electrically connected to said carriage terminal; and an ink tank removably mounted on said carriage and removably secured to said recording head, said ink tank having a capacity to store ink and having a tank information index located in said ink tank which transmits information relating to the ink tank, said tank information index being electrically connected to said carriage terminal, wherein said information relating to the ink tank is transmitted to said control means of said ink jet recording apparatus through said head terminal and through said carriage terminal, and wherein said information relating to said recording head is transmitted to said control means of said ink let recording apparatus through said carriage terminal.

2. A recording mechanism according to claim 1, wherein the transmission of said tank information index to said control means of said ink jet recording apparatus is reciprocal.

3. A recording mechanism according to claim 1, wherein said tank information index is an identification number of said ink tank.

4. A recording mechanism according to claim 1, wherein said tank information index is a characteristic of said ink tank.

5. A recording mechanism according to claim 1, wherein the transmitted tank information index is checked by said control means of said ink let recording apparatus.

6. A recording mechanism according to claim 1, wherein said recording head is limited to a usable number of ink tanks, and said recording head and said usable number of ink tanks are capable of enclosure within a single package for commercial distribution and sale.

7. A recording mechanism according to claim 1, wherein the transmission of said head information index to said control means of said ink let recording apparatus is reciprocal.

* * * * *

UNITED STATES PATENT AND TRADEMARK OFFICE

CERTIFICATE OF CORRECTION

PATENT NO. : 5,980,021 
DATED : November 9, 1999
INVENTOR(S) : Shigeyasu Nagoshi et al.

It is certified that error appears in the above-identified patent and that said Letters Patent is hereby corrected as shown below:

Title page,
Under FOREIGN PATENT DOCUMENTS, change "234647 10/1991 Japan" to -- 2-034647 10/1991 Japan --.

Column 1,
Line 27, change "and These" to -- There --;
Line 41, delete "since";
Line 62, change "a" to -- the --; and
Line 63, change "the" to -- its --.

Column 4,
Line 66, change "determined" to -- determining --.

Column 5,
Line 23, change "10º0" to -- 10º --.

Column 6,
Line 15, change "10º0" to -- 10º --.

Column 7,
Line 43, change "is" to -- are --.

Column 9,
Line 12, delete the first occurrence of "of".

Column 10,
Line 47, change "(latter" to -- (later --.

UNITED STATES PATENT AND TRADEMARK OFFICE

CERTIFICATE OF CORRECTION

PATENT NO. : 5,980,021
DATED : November 9, 1999
INVENTOR(S) : Shigeyasu Nagoshi et al.

It is certified that error appears in the above-identified patent and that said Letters Patent is hereby corrected as shown below:

Column 12,
Line 45, change “use” to -- used --; and
Line 53, change “used” to -- use --.

Signed and Sealed this

Ninth Day of July, 2002

*Attest:*

*Attesting Officer*

JAMES E. ROGAN
*Director of the United States Patent and Trademark Office*